US005661991A

United States Patent [19]

Hsu

[11] Patent Number: 5,661,991

[45] Date of Patent: Sep. 2, 1997

[54] COMBINATION LOCK DEVICE

[76] Inventor: Chung-Tang Hsu, No. 103, Wu-Kong Rd., Wu-Ku Ind. Park, Taipei Hsien, Taiwan

[21] Appl. No.: 622,625

[22] Filed: Mar. 27, 1996

[51] Int. Cl.[6] ..... E05B 37/02

[52] U.S. Cl. ..... 70/312; 70/78

[58] Field of Search ..... 70/78–84, 312, 70/314, 416, 417

[56] References Cited

U.S. PATENT DOCUMENTS

| | | | |
|---|---|---|---|
| 2,734,373 | 2/1956 | Scherbinski | 70/78 X |
| 3,908,416 | 9/1975 | Heine et al. | 70/71 |
| 4,569,213 | 2/1986 | Scelba | 70/312 X |
| 4,610,152 | 9/1986 | Duringer | 70/312 X |
| 4,732,021 | 3/1988 | Su | 70/312 |
| 4,766,748 | 8/1988 | Yang | 70/312 |
| 4,907,430 | 3/1990 | Hong | 70/312 |
| 4,991,416 | 2/1991 | Resendez et al. | 70/312 |
| 5,125,248 | 6/1992 | Ling | 70/312 X |
| 5,307,657 | 5/1994 | Klein et al. | 70/312 |
| 5,358,322 | 10/1994 | McLaughlin | 70/78 X |

*Primary Examiner*—Suzanne Dino
*Attorney, Agent, or Firm*—Bacon & Thomas

[57] ABSTRACT

A combination lock device includes a mechanical combination lock, a positioning plate, an extension shaft, a securing seat and an eccentric shaft. The combination lock consists of a housing, a lock shaft, a lock piece and a lock seat. When the number dials of the combination lock are turned to a set number, a lock hook of the combination lock disengages from a retain slot of the positioning plate. The combination lock may then be turned counter-clockwisely through 180 degrees so that the extension shaft and the eccentric shaft synchronously turn counter-clockwisely through 180 degrees, causing an eccentric rod linked up with a switch device in the drawer to displace through 180 degrees to allow opening of the drawer. In order to close the drawer, the procedure is reversed so that, after the combination lock and the positioning plate are positioned, the lock hook engages the retain hole by the turning of any one of the number dials.

4 Claims, 3 Drawing Sheets

COMBINATION LOCK DEVICE

BACKGROUND OF THE INVENTION (a) Field of the Invention

The present invention relates generally to a combination lock device, and more particularly to a combination lock device for drawers.

(b) Description of the Prior Art

Conventional locks for drawers are mostly used in conjunction with keys. If the key is lost, it will be a big problem to open the drawer once it is locked.

With reference to FIG. 1, which shows a conventional key lock for drawers, the lock comprises a core 10 with a keyway accommodated in a hole 201 of a securing frame 20. The core 10 is coupled with one end of an extension shaft (not shown) within the hole 201. The other end of the extension shaft is screwably locked with an eccentric shaft 40. When a key 50 is inserted into the keyway of the core 10, the core 10 may be turned through 180 degrees, bringing an eccentric rod at a front end of the eccentric shaft 40 to turn through 180 degrees, causing a longitudinally oriented, rectangular linking-up frame pre-disposed at an upper part of the drawer to displace downwardly, so that the drawer may be pulled open. If the core 10 is caused to turn through 180 degrees in a reverse direction, the eccentric rod 401 resets to its original position and the drawer is locked.

SUMMARY OF THE INVENTION

Accordingly, a primary object of the present invention is to provide a combination lock for drawers of desks, cabinets and the like to eliminate use of keys.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
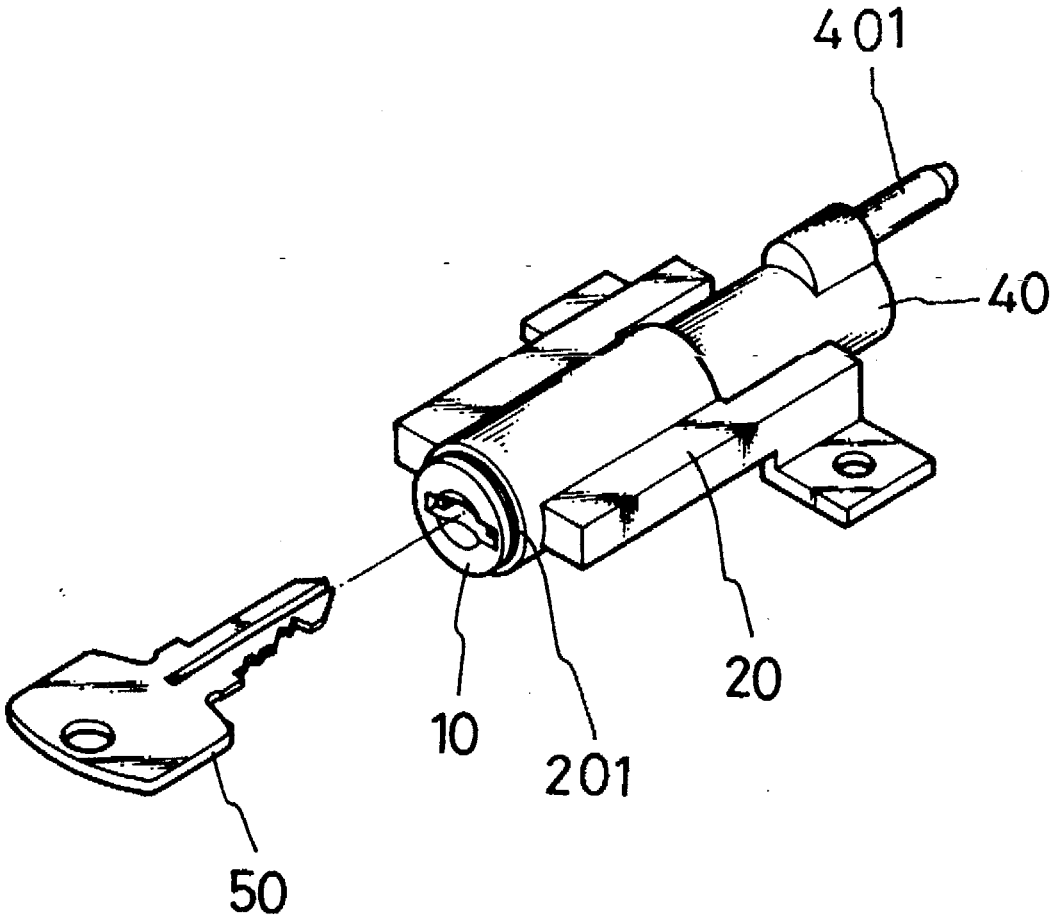
(PRIOR ART) FIG.1
FIG. 1 is a schematic view of a conventional drawer lock.
Figure 2:
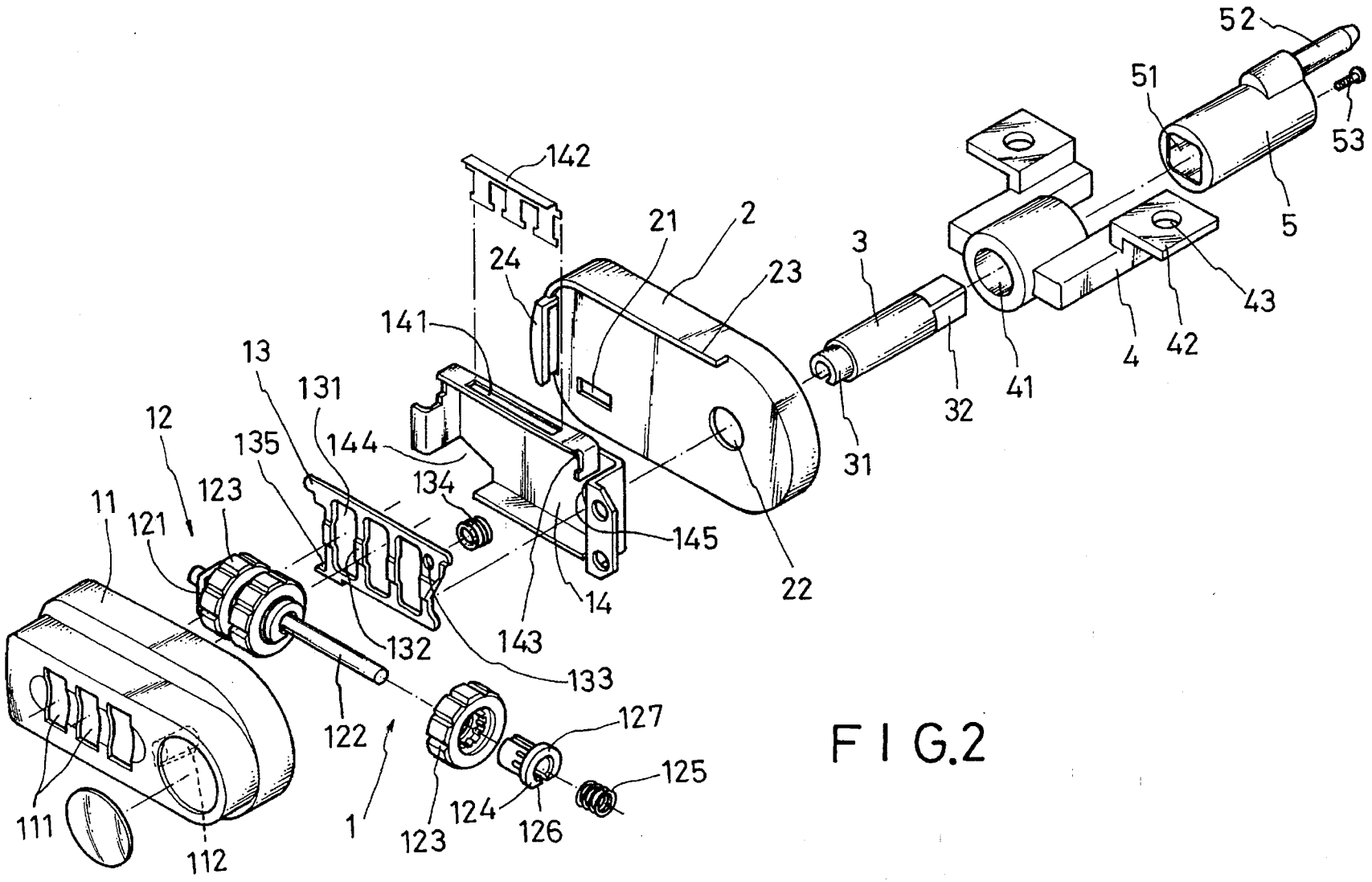
FIG. 2 is an elevational, exploded view of a combination lock for drawers according to the present invention.

With reference to FIG. 2, the combination lock device according to the present invention essentially comprises a combination lock 1, a positioning plate 2, an extension shaft 3, a securing seat 4 and an eccentric shaft 5.

Figure 4:
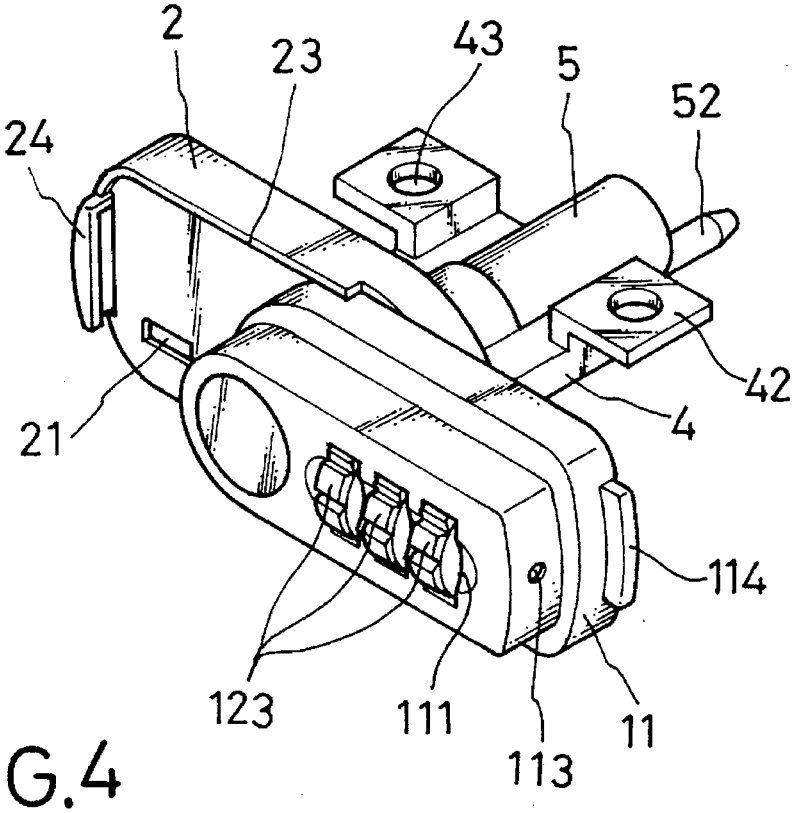
FIG. 4 is an elevational view of the combination lock when in use.

The combination lock 1, like conventional mechanical combination locks, essentially comprises a housing 11, a lock shaft 12, a lock piece 13 and a lock seat 14. A front side of the housing 11 is provided with multiple elongate windows 111. The lock shaft 12 has one side thereof integrally extending to form an L-shaped push lever 121 and has a lock rod 122 having fitted thereon multiple number dials 123 and bushings 124 matching the elongate windows 111 in number. A shaft spring 125 is fitted onto an extreme end of the lock rod 122. The entire lock shaft 12 is accommodated within the housing 11, with a part of each of the number dials 123 projecting from each of the windows 111 for pushing by a user's fingers. In addition, each bushing 124 is insertably coupled with its corresponding number dial 123 so that it may rotate therewith. Each bushing 124 is further provided with a flange surface 126 and a curved rim 127 so that, when the number dial 123 rotates and the flange surfaces 126 of all the bushings 124 are on the same plane, the user may, via a hole 113 (see FIG. 4), press the lock shaft 12 to compress the shaft spring 125, causing the push lever 121 to synchronously push the number dials 123, thereby causing the bushings 124 to disengage from the corresponding number dials 123. At this point, the user may reset the code. As this is well known to those skilled in the art, it will not be discussed in detail herein. A salient feature of the housing 11 according to the present invention resides in the arrangement of a horizontal post 112 projecting integrally from one side of the housing 11 for insertably coupling with the extension shaft 3.

The lock piece 13 is located behind the lock shaft 12 and is provided with multiple hollowed holes 131 for matching the number dials 123 which may pass therethrough. The lock piece 13 is further provided with multiple strips 132 for matching the bushings 124. At one corner of the lock piece 13, a lug 133 projects rearwardly therefrom. The lug 133 is fitted with a spring 134. A salient feature of the lock piece 13 resides in the arrangement of a lock hook 135, which extends rearwardly from a lower left corner of the lock piece for fastening with the positioning plate 2.

The lock seat 14 is disposed behind the lock piece 13. An upper side of the lock seat 14 is provided with a slot 141 for insertion therein a resilient piece 142 for generating sounds when the number dials 123 are turned and for positioning the number dials 123 when they are not rotated. The lock seat 14 is provided with a lug 143 for matching the spring 134 so that the spring 134 may be sandwiched between the lock seat 14 and the lock piece 13 and the lock piece 13 may reciprocate. In assembling the lock seat 14, it is secured to the rear side of the housing 11 by means of a fastening strip and mounting holes respectively at both sides thereof. A salient feature of the lock seat 14 of the present invention resides in the arrangement of a notch 144 at a lower left corner thereof for passage of the lock hook 135 and a seat hole 145 at a positioning corresponding to that of the post 112 of the housing 11 for passage of the extension shaft 3.

The positioning plate 2 is a substantially elliptical flat structure having a size matching that of the housing 11. A retain slot 21 for retaining the lock hook 135 is formed at a left side of the positioning plate 2 while a plate hole 22 is formed at the left side thereof for passage of the extension shaft 3. In order to prevent the combination lock 1 from resetting, a flanged portion 23 is a provided at an upper rim of the positioning plate 2, the width thereof being smaller than that of the housing 11 so that the user may easily push the upper rim of the housing 11 without touching the flanged portion 23. At the same time, in order to position the positioning plate 2 and the housing 11, a substantially L-shaped retain portion 24 is provided to project integrally from one lateral side of the positioning the plate 2. Correspondingly, the housing 11 has a rib 114 (see FIG. 4) extending from one lateral side thereof so that the rib 114 may engage with the retain portion 24.

The extension shaft 3 is a rod-like structure having a first stem portion 31 passing through the plate hole 22, the seat hole 145 and the lock piece 13 to couple with the post 112 such that they are in a linking-up relationship, whereas a second stem portion 32 passes through the securing seat 4 to couple with the eccentric shaft 5.

The securing seat 4 consists of a central hole portion 41 for passage of the second stem portion 32 of the extension shaft 3 and two wings 42 extending respectively from both sides of the central hole portion 41 such that said wings 42 are at a level higher than that of the central hole portion 41. The wings 42 are respectively provided with a lock hole 43 through which a screw may pass to securing the securing seat 4 to a determined position of a desk or cabinet.

The eccentric shaft 5 is also a rod-like structure having a central hole 51 at one end thereof for receiving the second stem portion 32 of the extension shaft and an eccentric rod 52 protrudently formed at the other end thereof for passage into a switch means pre-disposed in a conventional drawer. The eccentric shaft 5 and the extension shaft 3 may be locked together by means of a screw 53.

Figure 3:
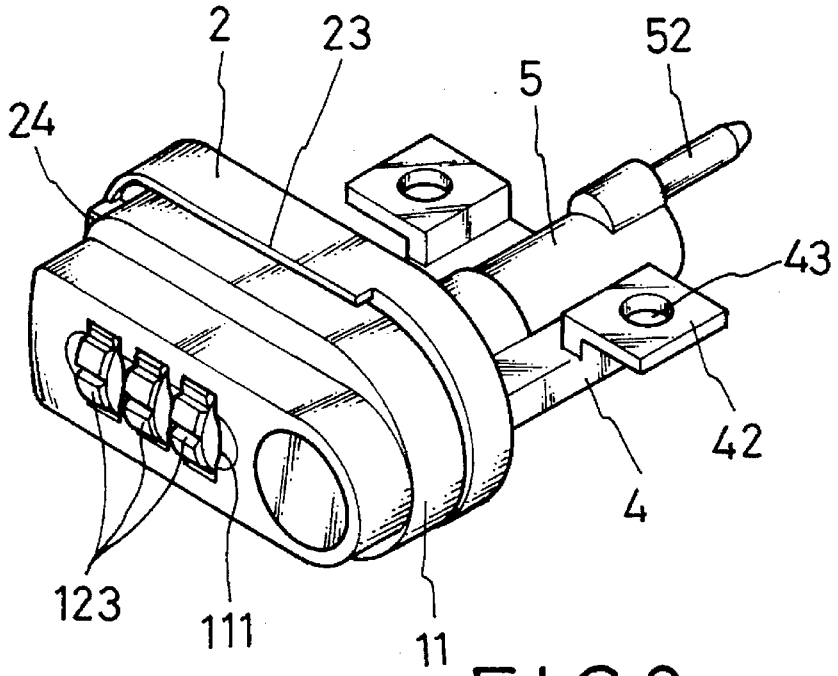
FIG. 3 is an elevational view of the combination lock of the invention in an assembled state.

With reference to the drawings, in assembly, the housing 11, the lock shaft 12, the lock piece 13 and the lock seat 14 are assembled in sequence to constitute the combination lock 1. Then the first stem portion 31 of the extension shaft 3 is passed through the plate hole 22 and the seat hole 145 to couple with the post 112 in the housing 11, while the second stem portion 32 of the extension shaft 3 is passed through the central hole portion 41 of the securing seat 4 to couple with the central hole 51 of the eccentric shaft 5. The screw 53 is then used to lock the eccentric shaft 5 and the extension shaft 3. At this time, the lock hook 135 engages the retain slot 21, and the positioning plate 2 and the securing seat 4 are secured together, with the wings 42 locked at a predetermined position of the drawer thereby firmly positioning the securing seat 4 and the positioning plate 2 on the drawer. FIG. 3 shows the combination lock device of the invention in an assembled state.

In order to open the drawer, it is merely necessary to turn the number dial 123 to a predetermined code number so that the strips 132 of the lock piece 13 lose support of the curved rims 127 of the bushings 124 and, by means of the resilience of the spring 134, the lock piece 13 is caused to displace forwardly to cause the flange surfaces 126 to be in contact with the strips 132. At this time, the lock hook disengages from the retain slot 21 and retracts forwardly so that the combination lock 1 and the positioning plate 2 are separated. At this point, with reference to FIG. 4, the user may push the housing 11 through 180 degrees in a counter-clockwise direction so that the extension shaft 3 pivotally connected thereto is also synchronously turned through 180 degrees, while the eccentric rod 52 of the eccentric shaft 5 at the pre-disposed switch means also turns through 180 degrees, allowing the user to open the drawer.

In order to close the drawer, it is only necessary to turn the combination lock 1 through 180 degrees in a clockwise direction so that the upper rim of the housing 11 abuts the flanged portion 23 of the positioning plate 2, causing the eccentric rod 52 to reset. The number dials 123 may then be turned at random so that the curved rim 127 of any one of the bushings 124 contacts one of the strips 32, causing the lock piece 13 to displace rearwardly, so that the lock hook 135 engages the retain slot 21, as shown in FIG. 3.

Although the present invention has been illustrated and described with reference to the preferred embodiment thereof, it should be understood that it is in no way limited to the details of such embodiment but is capable of numerous modifications within the scope of the appended claims.

What is claimed is:

1. A combination lock device for drawers, comprising:

a combination lock, being a flat oblong structure and comprising a housing, a lock shaft, a lock piece and a lock seat, said housing having a post which projects horizontally from one side thereof, and having said lock shaft fitted with a plurality of number dials and bushings, each of said bushings being provided with a flanged surface and a curved rim and matching one of a plurality of strips provided on said lock piece, said lock piece having a lock hook projecting from a first lateral side thereof, a spring located between a second lateral side of said lock piece and said lock seat such that said lock piece may reciprocate, said lock seat having a notch at a first side thereof configured to engage said lock hook, and a seat hole at a second thereof for passage of an extension shaft for sealing an open end at a rear side of said housing;

a positioning plate, being a flat oblong structure and having a retain slot at a position matching that of said lock hook and a plate hole at a position matching that of said seat hole;

said extension shaft comprising a first stem portion extending through said plate hole and said seat hole coupled with said post of said housing and a second stem portion extending through a securing seat coupled with an eccentric shaft;

said securing seat coupled with said positioning plate, said securing seat comprising a central hole portion for passage of said second stem portion, a wing extending from both sides of said central hole portion and being at a higher level than that of said central hole portion, each of said wings having a lock hole; and, said eccentric shaft, having a central hole for passage of said second stem portion and an eccentric rod protruding from a rear end thereof; whereby, by adjusting said number dials to a pre-set code number, said lock piece is enabled to be displaced forwardly so that said lock hook disengages from said retain hole and by turning said housing through 180 degrees, said extension shaft and said eccentric shaft are synchronously caused to turn through 180 degrees in the same direction, thereby allowing opening of the drawer.

2. The combination lock device as claimed in claim 1, further comprising a flanged portion protruding from an upper rim of said positioning plate for restricting turning of said combination lock.

3. The combination lock device as claimed in claim 1, further comprising an L-shaped retain portion horizontally extending from a side of said positioning plate, and a rib on said combination lock located at a position matching that of said retain portion for positioning and coupling purposes.

4. The combination lock device as claimed in claim 1, wherein said lock shaft is provided with an L-shaped push lever to allow pressing of a lock rod to cause said bushings to disengage from said number dials when said flanged surfaces of said bushings are in a common plane so as to allow resetting of the number codes.

* * * * *